United States Patent [19]

Wood

[11] Patent Number: 4,622,755

[45] Date of Patent: Nov. 18, 1986

[54] PARALLEL STRAIGHTEDGE

[76] Inventor: Russell J. Wood, P.O. Box A8 Bailey Rd., Lansboro, Mass. 01237

[21] Appl. No.: 839,512

[22] Filed: Mar. 14, 1986

[51] Int. Cl.[4] ..... B43L 13/02

[52] U.S. Cl. ..... 33/444

[58] Field of Search ..... 33/443, 444

[56] References Cited

U.S. PATENT DOCUMENTS

| | | | |
|---|---|---|---|
| 2,102,008 | 12/1937 | Klitsche | 33/444 |
| 3,283,410 | 11/1966 | Truhon | 33/444 |
| 4,339,881 | 7/1982 | Kapp | 33/444 |

FOREIGN PATENT DOCUMENTS

| | | | |
|---|---|---|---|
| 214227 | 6/1956 | Australia | 33/444 |
| 1077041 | 4/1954 | France | 33/444 |
| 1234909 | 5/1960 | France | 33/444 |
| 1421966 | 11/1965 | France | 33/444 |

*Primary Examiner*—Harry N. Haroian

[57] ABSTRACT

A parallel straightedge which may be attached to any drawing table wherein the straightedge is arranged for adjustment and is provided with a braking arrangement to allow the straightedge to be fixedly held in any given position and/or orientation. The bottom of the straightedge is arranged on a pair of rollers outboard the working area in order not to smudge the drawing contained thereon. A removable plastic insert along the edge of the metal straightedge bar provides a consistent transparent ruling edge for drawing straight lines while providing a nick-free edge as a guide for cutting instruments when the transparent edge is removed.

14 Claims, 7 Drawing Figures

PARALLEL STRAIGHTEDGE

BACKGROUND OF THE INVENTION

The invention relates to a straightedge arranged by means of cables to provide a parallel edge across the drawing table for drafting and graphic art purposes. In the movement of the conventional straightedges along the table, particles of graphite and dust become trapped between the bottom surface of the straightedge and the paper causing the paper to become smudged. An early attempt to avoid smudging is found in U.S. Pat. No. 2,234,467 entitled "Draftsman's Straightedge" wherein a plurality of rollers are arranged on the bottom surface of the straightedge to provide for clearance between the straightedge bottom and the paper. In this arrangement, the rollers themselves traverse across the paper and sometimes trap the graphite and dust particles in the vicinity of the rollers. Although the straightedge does not rest directly on the drawing, the rollers themselves roll on the surface and cause smudging along the path they traverse.

U.S. Pat. No. 1,584,839 entitled "Ruling Edge Device" also describes an earlier attempt to reduce smudging when straightedge devices are moved across a drawing table.

In both of these patents, the smudging is localized to the regions of the straightedge that trap the graphite and dust particles and, in some instances, actually intensify the smudging problem.

Another problem involved with movement of a straightedge across a drawing table is that of holding the straightedge in a restrained movable position on an inclined drafting table as well as a fixed position on a table which is horizontal or inclined. Most straightedges that are supported by means of cables have braking systems which clamp the cable to the straightedge causing the cable to become abraided over periods of continuous use eventually resulting in cable breakage.

When the integral transparent edge of straightedges are used as a guide for sharp instruments while cutting paper, film etc., the edge is frequently nicked thereby rendering the straightedge useless as a precision drawing instrument leading to inconvience and the expense of replacement of the entire straightedge assembly.

The parallel straightedge arrangement of the instant invention accordingly provides a smudge-free straightedge with a unique braking system that does not damage the cable while holding the straightedge fixedly in any position. The instant invention also includes a removable transparent plastic insert for drawing straight continuous parallel lines when inserted while allowing the durable metal nick-free edge of straightedge bar to be used as a guide for sharp cutting instruments when the transparent edge is removed.

SUMMARY OF THE INVENTION

The invention comprises a parallel straightedge for drawing tables wherein the straightedge consisting of a pair of longitudinal metal side frames joined by a planar metal strip forms an integral structural beam elevated above the drafting table surface by supports located at each end. A pair of pulleys arranged one over the other at each end, in cooperation with breaking supports, guide and support the cable which is attached to the table and passes longitudinally through the straightedge blade. The straightedge is guided along the cables in a parallel motion relative to the drawing table and is held in a fixed or restrained movable position by either or both of the braking means located at the ends of the straightedge. Rollers are provided on the ends of the straightedge subjacent the extruded side frames and outboard the working surface of the table. The edges of the metal straightedge bar provide nick-free guides for sharp cutting instruments. The removable plastic ruling edge provides for a transparent drawing edge when inserted into the edge of the straightedge bar.

DESCRIPTION OF THE PREFERRED EMBODIMENT

Figure 1:
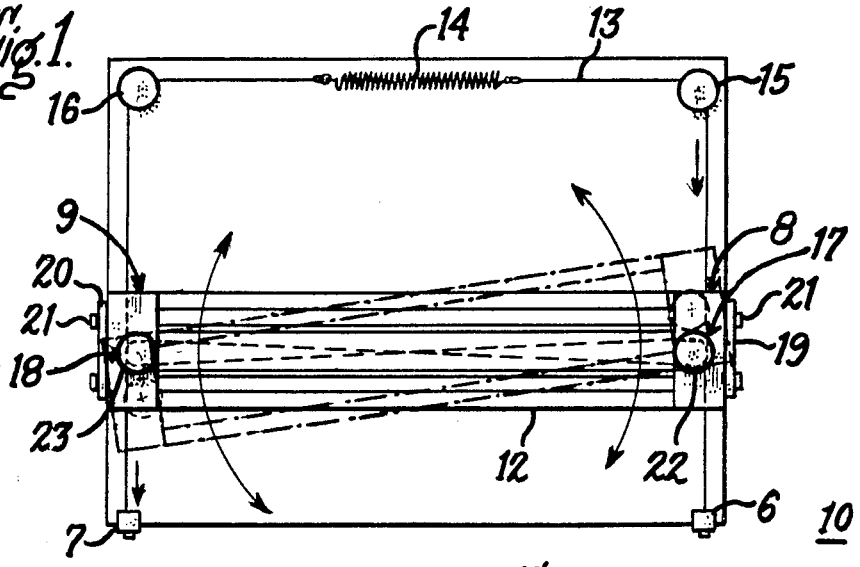
FIG. 1 is a plan view of the straightedge according to the invention mounted on a drawing table.
Figure 2:
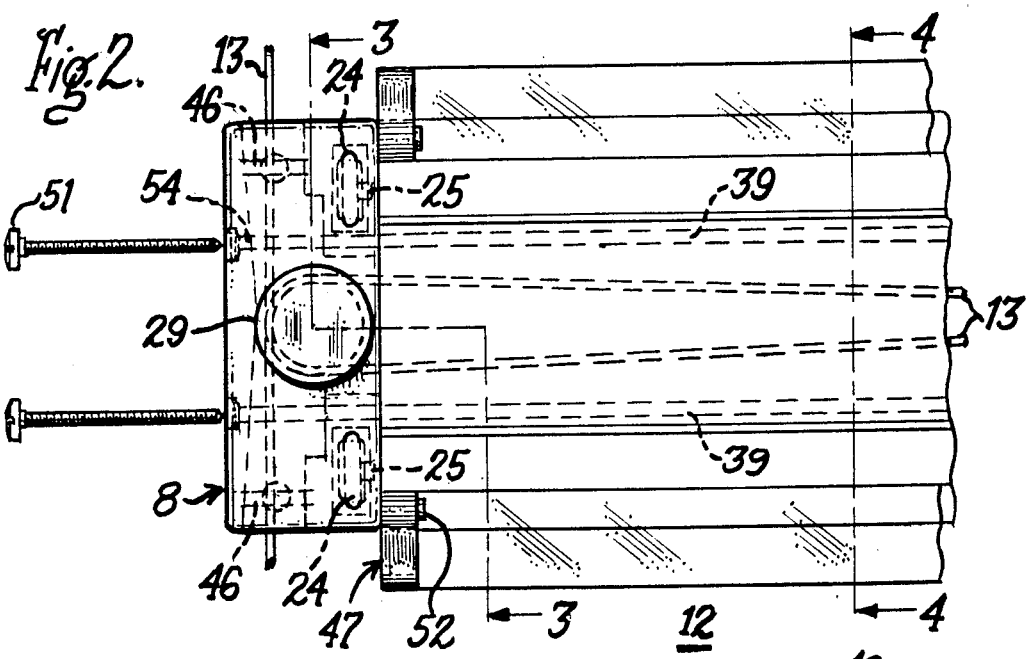
FIG. 2 is an enlarged plan view of one of the carriages at each end of the straightedge depicted in FIG. 1.
Figure 7:
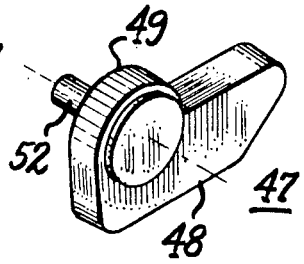
FIG. 7 is a side perspective view of a locking arm used within the carriage assembly depicted in FIG. 3.
Figure 3:
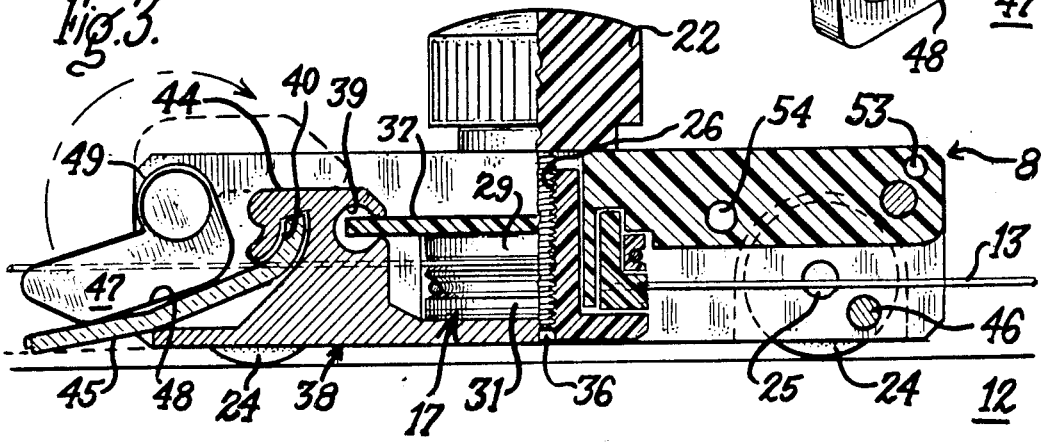
FIG. 3 is an enlarged sectional view of the straightedge blade and carriage assembly taken along line 3—3 of FIG. 2.
Figure 4:
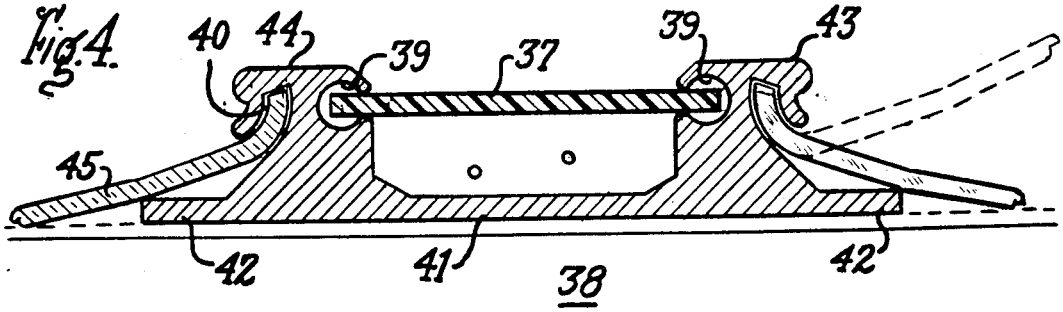
FIG. 4 is a enlarged sectional view of the straightedge blade taken along line 4—4 of FIGS. 1, 2 and 3.

A drawing table 10 is depicted in FIG. 1 with the inventive straightedge 12 positioned thereon by means of a continuous cable 13 arranged around a pair of cable locks 15, 16 at the top of the drawing table and terminating in a pair of cable supports 6 and 7 which are fastened to the table at the bottom. A tension spring 14 connected with the cable provides the proper tension to the cable required to insure the parallel relationship of the straightedge as it is moved along the cable in the vertically indicated direction. Carriages 8, 9 at opposite ends of the straightedge provide motive means for the straightedge as well as supporting the brake assemblies 17, 18 for holding the straightedge in a fixed or restrained movable position with respect to the continuous cable. Besides movement in the vertically indicated direction, the straightedge is capable of rotary adjustment as indicated in phantom. A pair of guides 19, 20 are arranged at the opposite sides of the straightedge and are attached to the straightedge by means of screws 21. These guides assist in positioning the straightedge transverse to the linear extent of the cable. A pair of braking knobs 22, 23 are accessible on the top surface of the brake assembly for allowing the straightedge to be fixedly retained at a predetermined location along the continuous cable in a manner to be discussed below in some detail. The straightedge 12 is depicted in FIG. 2 with one carriage 8 attached to the end of the straightedge by means of long screws 51 extending through holes 54 within the carriage and engaging a pair of extrusions 39 formed within the straightedge. The braking knob 22 is removed to show a top pulley 29 arranged within the carriage as part of the brake assembly around which the continuous cable 13 is arranged as indicated. A pair of rollers, 24 are rotatably mounted within the carriage by means of axles 25. The brake assembly 17 is shown to consist of the top pulley 29 arranged over a bottom pulley 31 and arranged subjacent the braking knob 22 such that the threaded shaft 26 extending from the bottom of the braking knob engages the threads formed within the threaded opening 36 located within the bottom of the carriage. Also seen in FIG. 3 is the roller 24 held within the carriage by means of axle 25. The straightedge includes an extruded aluminum support 38 best seen in FIG. 4 to contain a pair of side frames 43, 44 joined by means of a support base 41. A plastic cover 37 extends between the side frames by means of grooves 39 formed during the extrusion process. A pair of blade extensions 42 integrally formed within the extruded aluminum support serve as guides for sharp instruments used for cutting paper, film, photographs etc. when the plastic ruling edge 45 is removed from the slot 40 also formed within the extruded aluminum support during the extrusion process. The transparent plastic ruling edge serves as a continuously smooth guide for pencils, inking pens and other drawing instruments when inserted in the the slot 40 of the extruded aluminum straightedge blade and is replaceable in case of damage. Cable alignment pins 46 pass through the cable space in the carriage to prevent the cable from becoming disengaged from the pulleys. Referring back to FIG. 3, a locking arm 47 is pivotally supported within the carriage for holding the plastic ruling edge in the slot 40 of the side frame 44. The locking arm includes a planar bottom 48 for abutting with the plastic insert 45 and a circular top portion form which a pin 52 extends as best seen in FIG. 7.

Referring back to FIG. 3, the locking arm 47 is attached to the carriage 8 by means of a press fit connection between the pin 52 and a hole 53 formed within the carriage.

Figure 5:
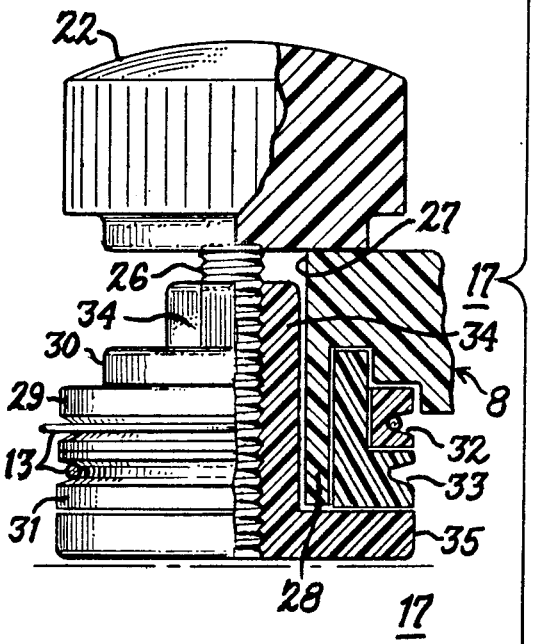
FIG. 5 is an enlarged side view and partial section of the braking arrangement used with the straightedge depicted in FIG. 1.
Figure 6:
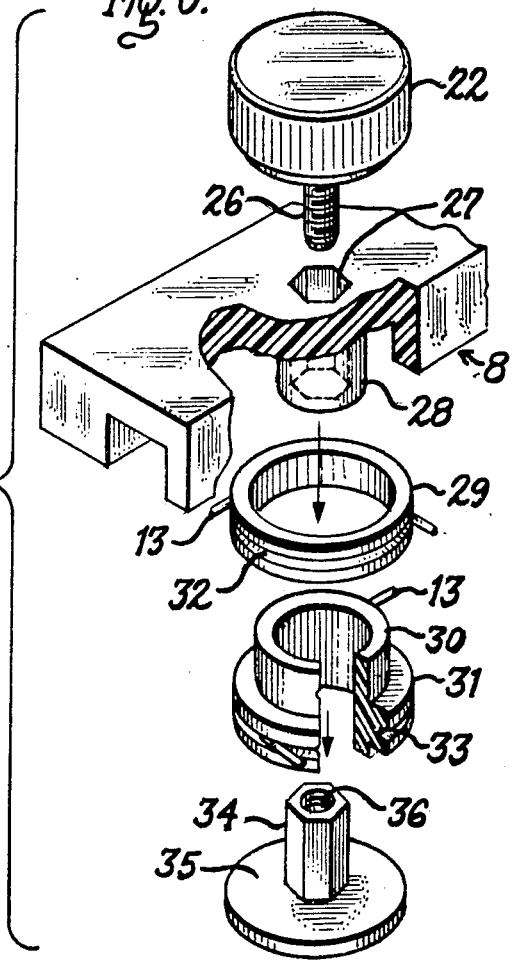
FIG. 6 is an enlarged top perspective view of the braking arrangement of FIG. 5 is isometric projection.

The brake assembly 17, is depicted in FIG. 5 to show the cooperative arrangement between the braking knob 22 and the top and bottom pulleys 29, 31 in greater detail. The method of assembling the brake assembly is shown if FIG. 6 and reference will be made now to both the figures. The braking knob 22 is assembled to the carriage 8 by the insertion of the threaded shaft 26 through a hexagonal slot formed within the carriage which receives a hexagonal pedestal 34 integrally formed onto a circular base member 35. A boss 28 extending from the carriage extends through the top and bottom pulleys 29, 31 such that the flange extending from the bottom pulley nests against the carriage when the threaded shaft is received within the the threaded opening. The continuous cable 13 winds from the top pulley of carrage 8 to the bottom pulley of carriage 9 and from the top pulley of carriage 9 to the bottom pulley of carriage 8 by means of circumferential grooves 32 and 33. When the knob is turned clockwise, the base member 35 is tightly drawn up against the bottom pulley thereby introducing frictional rotational restraint upon the pulleys which produces a variable braking action depending on the pressure exerted by the rotation of the knob. The circumferental grooves in the pulleys are slightly narrower than the diameter of the cable thereby preventing slippage of the cable around the pulleys thereby restraining the movement of the straightedge without abrading the cable.

Referring once again to FIG. 1, the straightedge 12 can be rotatably adjusted by loosening the cable locks 15,16 and rotating the straightedge to the desired orientation. When the knobs are turned clockwise to tighten the cable locks, the cable is held in the desired position maintaining the straightedge in continuously parallel relationship to the drawing table as it is moved from one location to another.

I claim:

1. A parallel straightedge comprising:

a pair of first and second carriage members attached to opposite ends of a double-edged metal formation for supporting said metal formation upon a drawing board;

a continuous cable arranged about a pair of cable guides at one end of the drafting board and secured to said drawing board at an opposite end; and a pair of first and second cable brakes carried by said first and second carriage members, said cable brakes comprising first and second knobs having a threaded shaft and a base having a threaded pedestal, said threaded shaft extending through at least one apertured pulley to within said threaded pedestal whereby said continuous cable is arranged about said apertured pulley and said pulley becomes blocked when said threaded shaft engages said threaded pedestal a predetermined distance.

2. The parallel straightedge of claim 1 wherein said first and second carriage members each comprise a top and a bottom surface joined by a side plate, said first and second knobs being arranged on said top surface, and first and second pairs of rollers being arranged on said bottom surface for contacting a top surface of said drawing board.

3. The parallel straightedge of claim 1 wherein said top surface of said drawing board defines a working surface for supporting a paper and a travel surface outboard said working surface for supporting said first and second pairs of rollers.

4. The parallel straightedge of claim 1 wherein said continuous cable defines a loop having a pair of ends and wherein said ends are connected together by means of a tension spring.

5. The parallel straightedge of claim 1 wherein said double-edged metal formation comprises a metal extrusion having a pair of first and second side frames joined by means of a planar metal strip.

6. The parallel straightedge of claim 5 including a first plurality of grooves extending through said first metal side frame and a second plurality of grooves extending through said second metal side frame.

7. The parallel straightedge of claim 6 wherein said first and second carriage members are attached to said double-edged metal formation by insertion of screws through said first and second carriage members to within said first and second side frames.

8. The parallel straightedge of claim 6 further including a metal cutting edge formed on said double-edged metal formation.

9. The parallel straightedge of claim 6 further including a plastic drawing edge insert removably attached to said double-edged metal formation by means said first and second grooves.

10. The parallel straightedge of claim 9 wherein said plastic drawing edge insert is co-extensive with said first and second metal side frames.

11. The parallel straightedge of claim 8 wherein said metal cutting edge is co-extensive with said first and second metal side frames.

12. The parallel straightedge of claim 1 wherein said first and second carriage members comprise molded plastic.

13. The parallel straightedge of claim 9 including a pair of plastic guide members attached to said first and second carriage members for slidingly receiving said plastic drawing edge insert.

14. The parallel straightedge of claim 13 wherein said plastic guide members each comprise a circular member with an integral tapered linear extension, said circular members including an integral mounting pin protruding perpendicular therefrom for insertion within a corresponding opening within each of said carriage members.

* * * * *